US006280374B1

(12) United States Patent
Manico et al.

(10) Patent No.: US 6,280,374 B1
(45) **Date of Patent: *Aug. 28, 2001**

(54) MULTI-VIEW PRINT CUTTING APPARATUS USING LENTICULAR MATERIAL AS AN ALIGNMENT GUIDE

(75) Inventors: Joseph A. Manico, Rochester; John H. Rosenburgh, Hilton; Roman Lucyszyn, Rochester, all of NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/034,677

(22) Filed: Mar. 4, 1998

(51) Int. Cl.[7] ..... B31B 1/88
(52) U.S. Cl. ..... 493/320; 493/324; 493/325
(58) Field of Search ..... 83/195, 681; 355/33, 355/22, 91, 72, 74, 75, 123; 493/187, 11, 320, 324, 325, 475; 53/390

(56) References Cited

U.S. PATENT DOCUMENTS

| | | | |
|---|---|---|---|
| 3,704,067 | | 11/1972 | Womack . |
| 4,448,520 | * | 5/1984 | Achtman et al. . |
| 4,558,619 | | 12/1985 | Caumont . |
| 5,015,222 | * | 5/1991 | Bunch, III . |
| 5,146,703 | | 9/1992 | Boden . |
| 5,172,622 | | 12/1992 | Sabin . |
| 5,222,347 | | 6/1993 | Gerrans . |
| 5,391,254 | | 2/1995 | Morton . |
| 5,424,553 | | 6/1995 | Morton . |
| 5,426,914 | * | 6/1995 | Weder et al. . |
| 5,473,406 | | 12/1995 | Hassall et al. . |
| 5,479,270 | | 12/1995 | Taylor . |
| 5,492,578 | | 2/1996 | Morton . |
| 5,532,786 | | 7/1996 | Hassall et al. . |
| 5,681,676 | | 10/1997 | Telfer et al. . |
| 5,691,805 | * | 11/1997 | Lo et al. . |
| 5,731,883 | * | 3/1998 | Morton et al. . |
| 5,822,038 | * | 10/1998 | Slater et al. . |

FOREIGN PATENT DOCUMENTS

| | | |
|---|---|---|
| 3334114 A1 | 4/1985 | (DE) . |

* cited by examiner

*Primary Examiner*—Eugene Kim
(74) *Attorney, Agent, or Firm*—William F. Noval

(57) ABSTRACT

An apparatus for accurately cutting a multi-view print from a sheet of print material is disclosed comprised of a lower body portion and a cutter blade residing in the lower body portion. The cutter blade has a cutting outline corresponding to the outline of the to be cut multi-view print. An upper body portion is rigidly positioned with respect to the lower body portion and has a first opening therethrough corresponding to the outline of the cutter blade and second openings that are defined by the upper body portion for receiving a user's fingers so as to enable the movement of a sheet of print material when positioned between the upper and the lower body portions whereby a lenticular or barrier type cover sheet, positioned in the first opening, permits viewing of the multi-view print to enable the guiding of the sheet of print material into accurate alignment with the cover sheet prior to cutting with the cutter blade.

4 Claims, 4 Drawing Sheets

MULTI-VIEW PRINT CUTTING APPARATUS USING LENTICULAR MATERIAL AS AN ALIGNMENT GUIDE

CROSS-REFERENCE TO RELATED APPLICATIONS

The present application is related to U.S. application Ser. No. 08/857,110, filed May 15, 1997, by Peter A. Frosig, et al., and entitled, "System For Aligning Lenticular Images Using Line Sets With Different Line Colors;" and U.S. application Ser. No. 08/828,637, filed Mar. 31, 1997, by Roger R. A. Morton, and entitled, "Apparatus and Method For Aligning and Printing Integral Images."

FIELD OF THE INVENTION

This invention relates to various methods and apparatus for pre-aligning multi-view (3-D or motion) prints for use with lenticular cover sheets and/or lenticular print holders prior to cutting the prints to fit in a holder. The resulting multi-view print is accurately cut so that it provides superior registration with a selected lenticular cover sheet within the holder.

BACKGROUND OF THE INVENTION

Currently, numerous printing technologies including offset, therinal, inkjet, electophotographic, photo-optical, and photo-digital are used to generate multi-view prints. Once generated, these prints are used with lenticular cover sheets or lenticular holders to create multi-view images. Although not as popular, a cover sheet of barrier lines may also be used when spaced from the surface of the multi-view prints Some techniques require optical alignment after slow cure of UV cured optical cement is applied between the multi-view print and the lenticular cover sheet. The optical cement is set after a visual alignment is performed. Another technique uses a web of individual multi-view prints that is registered with and adhered to a web of lenticular material. For this technique to work the multi-view image printing and spacing must be in sync with the lentical pitch so that registration can be maintained throughout the entire length of the web. Individual multi-view images are then cut from the combined webs. Still another technique uses web printing with registered die cutters to produce individual multi-view prints for use with lenticular print holders. All of these techniques are used with volume production of multi-view images and are not readily applicable to on demand or single unit production. In addition, these techniques do not provide an alignment verification prior to cutting the multi-view print and/or laminating it to a lenticular or barrier type cover sheet.

In view of the limitations of the above described prior art it is the object of this invention to provide an apparatus and a method for verifying the alignment between a multi-view print and a lenticular or barrier type cover sheet prior to the cutting of the print. In addition, the multi-view image or an adjacent multi-view alignment target may be used to provide a means for visual alignment and alignment verification.

SUMMARY OF THE INVENTION

The present invention is directed to overcoming one or more of the problems set forth above. Briefly summarized, according to one aspect of the present invention there is provided an apparatus for accurately cutting a multi-view print from a sheet of print material, comprising:

a lower body portion;

a cutter blade residing in the lower body portion, said cutter blade having a cutting outline corresponding to the outline of the to be cut multi-view print;

an upper body portion rigidly positioned with respect to the lower body portion and having a first opening therethrough corresponding to the outline of the cutter blade;

means connected to the lower body portion for extending the cutter blade into the first opening in the upper body portion; and second openings defined by the upper body portion for receiving a users fingers so as to enable the movement of a sheet of print material when positioned between the upper and the lower body portions whereby a lenticular cover sheet positioned in the first opening permits viewing of the multi-view print to enable the accurate positioning of the sheet of print material prior to cutting with the cutter blade.

These and other aspects, objects, features, and advantages of the present invention will be more clearly understood and appreciated from a review of the following detailed description of the preferred embodiments and appended claims, and by reference to the accompanying drawings.

ADVANTAGEOUS EFFECT OF THE INVENTION

The present invention has the following advantages:

Can be used with multi-view (3-D or motion) image prints.

Can be used with multi-view alignment guides adjacent to the primary multi-view images.

Alignment is established prior to cutting.

After alignment and cutting, the resulting print can be used with lenticular or barrier type print holders without further alignment.

The die cut or lenticular or barrier alignment/cutting guide can produce a resulting multi-view (interleaved) print that fits directly into a pre-formed lenticular or barrier type print holder.

The lenticular or barrier alignment guides can be made adjustable to compensate for lot-to-lot variations of the multi-view print holders or to compensate for variability within the die or steel rule punches.

BRIEF DESCRIPTION OF THE DRAWINGS

To facilitate understanding, identical reference numerals have been used, where possible, to designate identical elements that are common to the figures.

DETAILED DESCRIPTION OF THE INVENTION

Figure 1A:
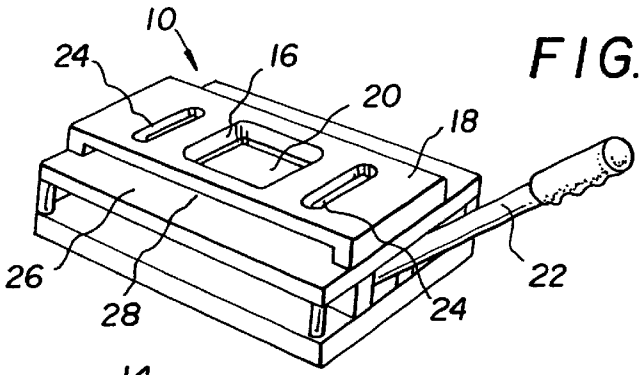
FIGS. 1A through 1F illustrate the steps of operation for the die punch of the present invention to form an accurately cut lenticular print.
Figure 1B:
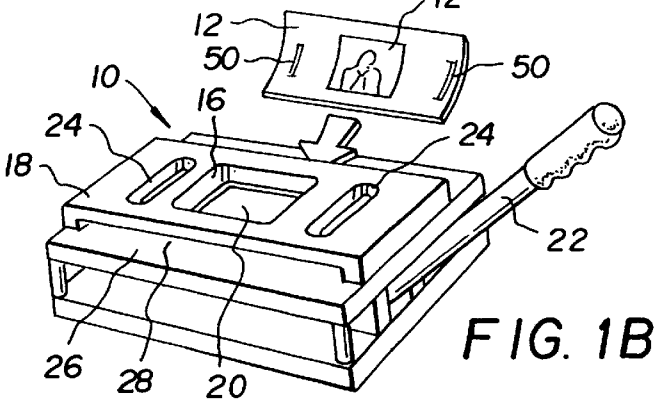
Figure 1C:
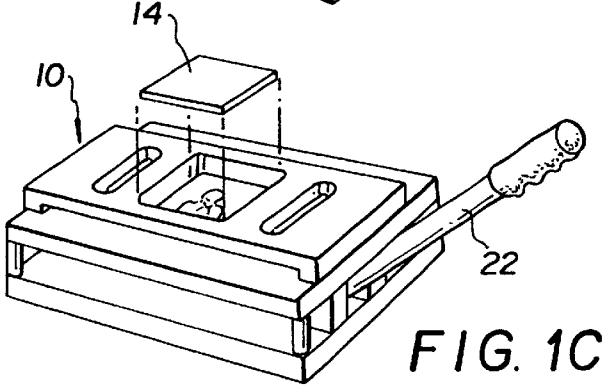
Figure 1D:
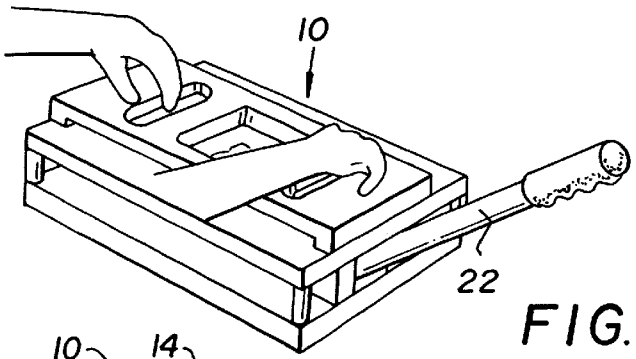
Figure 1E:
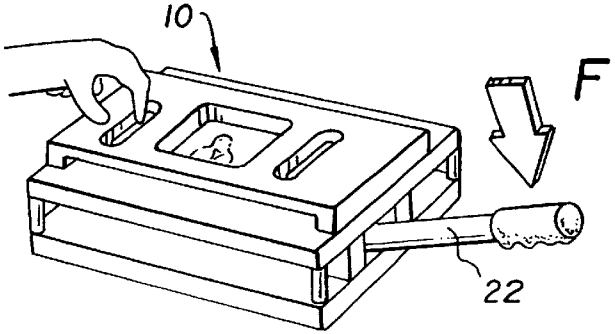
Figure 1F:
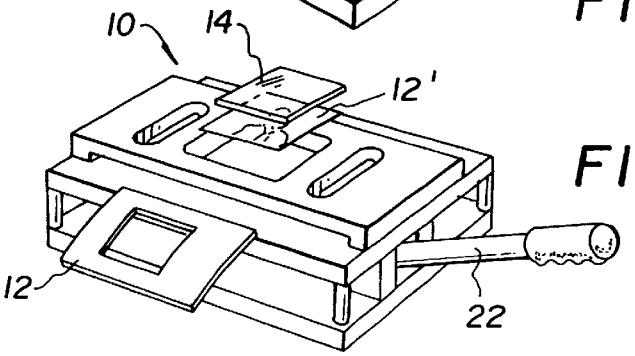

The method of the present invention may be used in conjunction with differing types of paper cutters some of which will be described in detail in the present description. In addition, although the preferred embodiments address the uses of lenticular sheets for forming multi-view cards, it is well known that barrier strip sheets are equivalent to lenticular sheets and that either may be used. FIGS. 1A through 1F show a preferred die type paper cutter 10 that enables precise alignment of a sheet of print material 12 containing a multi-view print 12' that is to be cut and joined with a lenticular cover plate 14 to form a 3D card or motion card dependent on the layout of the images printed on the multi-view print 12'. Referring specifically to FIG. 1A, the paper cutter 10 is provided with a precisely machined opening 16 that receives the lenticular cover plate 14 (ref. FIG. 1C). Cooperating with the machined opening 16 is a die cutter 20 that moves upward through a cutting position when a handle 22 is depressed. The die paper cutter 10 is formed with an upper body portion 18 and a lower body portion 26. A space 28, wide enough to accommodate the thickness of the sheet of print material 12, is provided to permit the sheet 12 to be positioned over the die cutter 20 while being held in a substantially flat position (ref. FIG. 1B). Two openings 24 are provided through the upper body portion 18 so that a user may position at least one finger through the openings 24 (ref. 1D). When the sheet of print material 12 is positioned over the die cutter 20 the lenticular cover plate 14 is dropped into the machined opening 16 holding it in exact alignment with respect to the die cutter 20. The user, per FIG. 1D, views the multi-view print 12' through the lenticular cover plate 14 and manipulates the orientation of the sheet of print material 12 to provide the best view of the image through the lenticular cover plate 14. When the collect orientation is achieved, the handle 22 is depressed and the die cutter 20 rises cutting the multi-view print 12' from the sheet of print material as illustrated in FIG. 1E. FIG. 1F illustrates the last step in the cutting process of removing the cut multi-view print 12' and the lenticular cover plate 14 along with the waste portion of the sheet of print material 12. The lenticular cover sheet 14 may then be bonded to the cut multi-view print 12' sheet or more preferably the two can be placed in a transparent housing (box) that has its inner dimensions equal to the outer dimensions of the lenticular cover sheet 14 combined with the multi-view print 12'. The cover sheet and the print would then be held in viewing alignment without the need for bonding.

Figure 2:
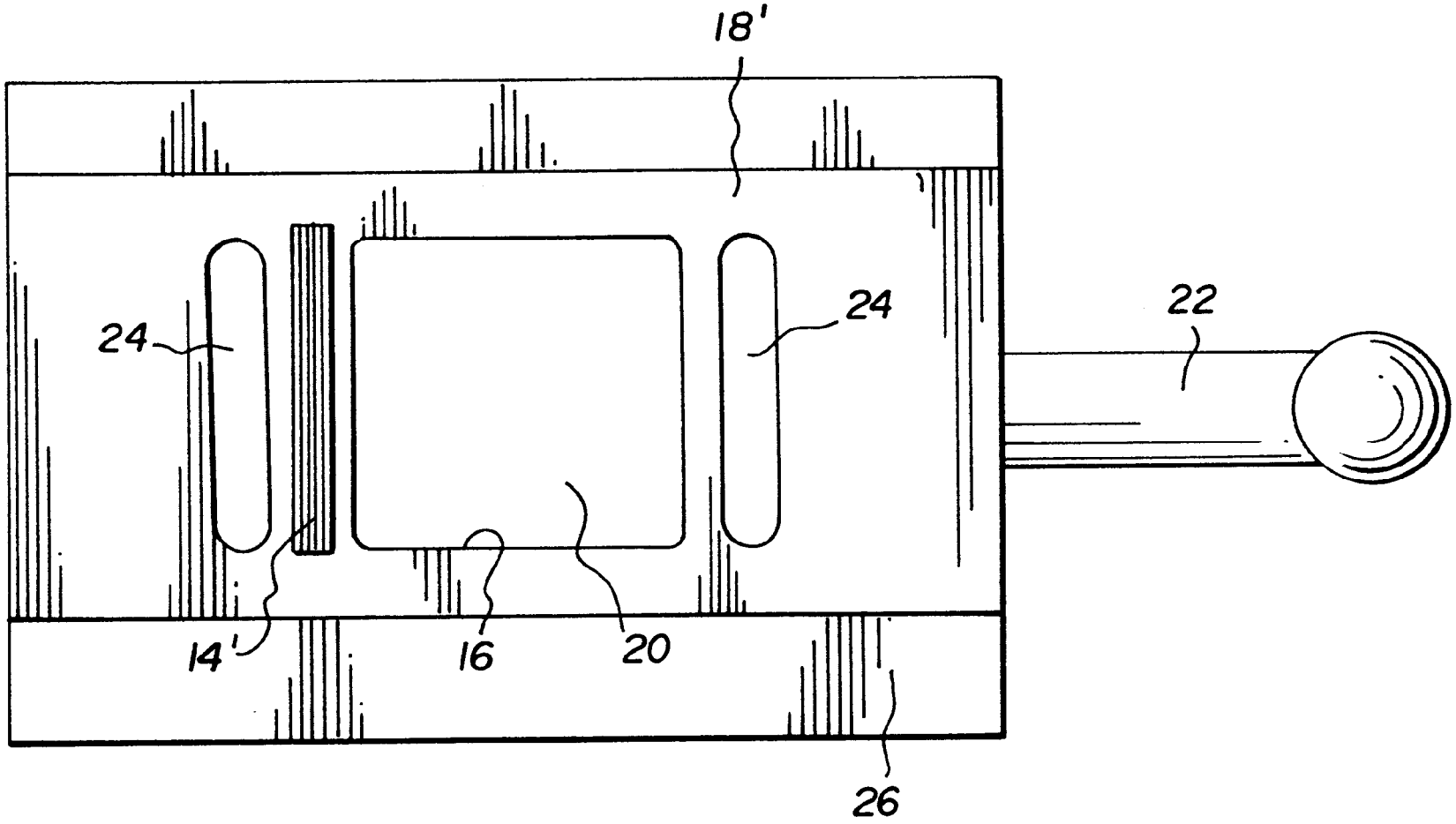
FIG. 2 is a top view of a die punch with a lenticular cover sheet over an adjacent multi-view alignment target window.

Referring to FIG. 2, a variant upper body portion 18' of the upper portion 18 of the paper cutter 10 is shown with the area over the die cutter 20 not receiving a lenticular cover sheet. Instead, a guide plate of lenticular material 1' is positioned outside of the viewing area of the image portion of the multi-view print 12' for alignment purposes. Printed on the sheet of print material 12 is a set of index marks 50 (see FIG. 1B) that will be positioned to be viewed through the guide plate of lenticular cover material 14' so as to provide a view to the user that indicates when the desired alignment is achieved. When the alignment is achieved the handle 22 is depressed and the sheet of print material 12 is cut. The portion of the sheet of print material 12 containing the alignment marks is scrap, and is discarded.

Figure 3:
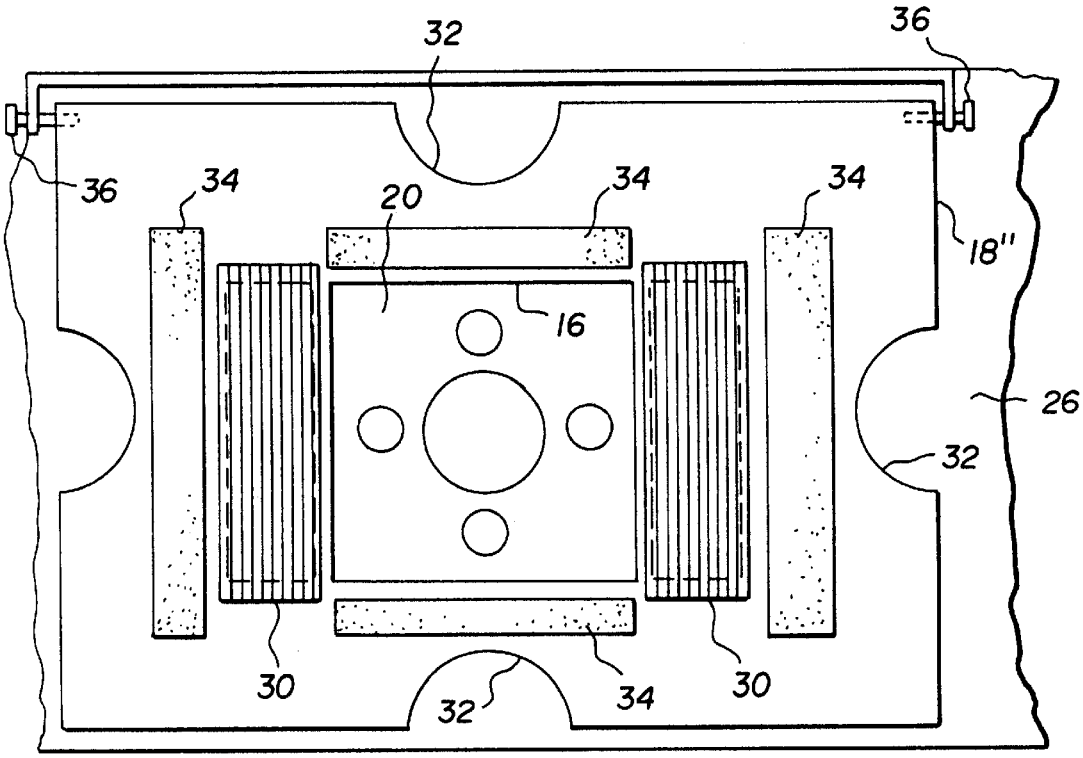
FIG. 3 is a top view of another die punch with lenticular cover sheets viewable in a pair of multi-view alignment target windows adjacent the window in which the print image is viewable.
Figure 4:
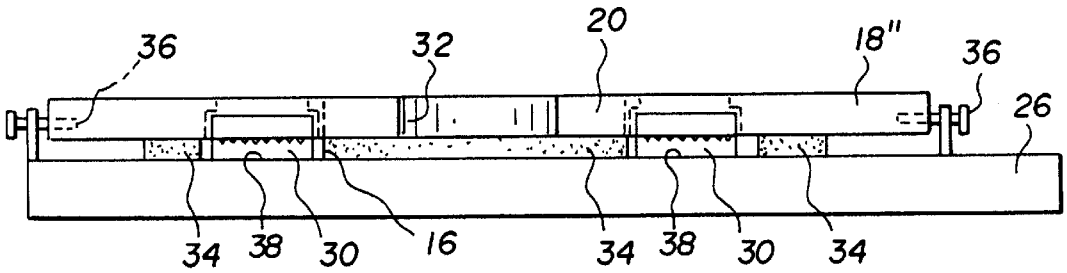
FIG. 4 is a side view of the die punch of FIG. 3.

Referring now to the paper cutter arrangement of FIG. 3 in conjunction with its side view in FIG. 4. In this arrangement, the upper body portion 18 is replaced with upper body portion 18" and a pair of guide plates of lenticular material 30 are positioned adjacent to the machined opening 16 through which the die cutter 20 moves. Below each of the guide plates of lenticular material 30 is an opening 38 that extends through the upper body portion 18". Instead of openings 24 being provided through the top member of 18 and 18", there is provided cut-outs (indents) 32 which permit the user's fingers to move the sheet of print material 12 when it is positioned over the die cutter 20. To resistively hold the sheet of print material 12 against random motion after alignment is achieved, anti-slip pads 34 are positioned around the periphery of the machined opening 16. In this particular cutter arrangement the upper body portion 18" is hinged by pins 36 to the lower body portion 26 enabling the sheet of print material 12 to be laid over the die cutter 20 rather than having it slid into place.

Figure 5:
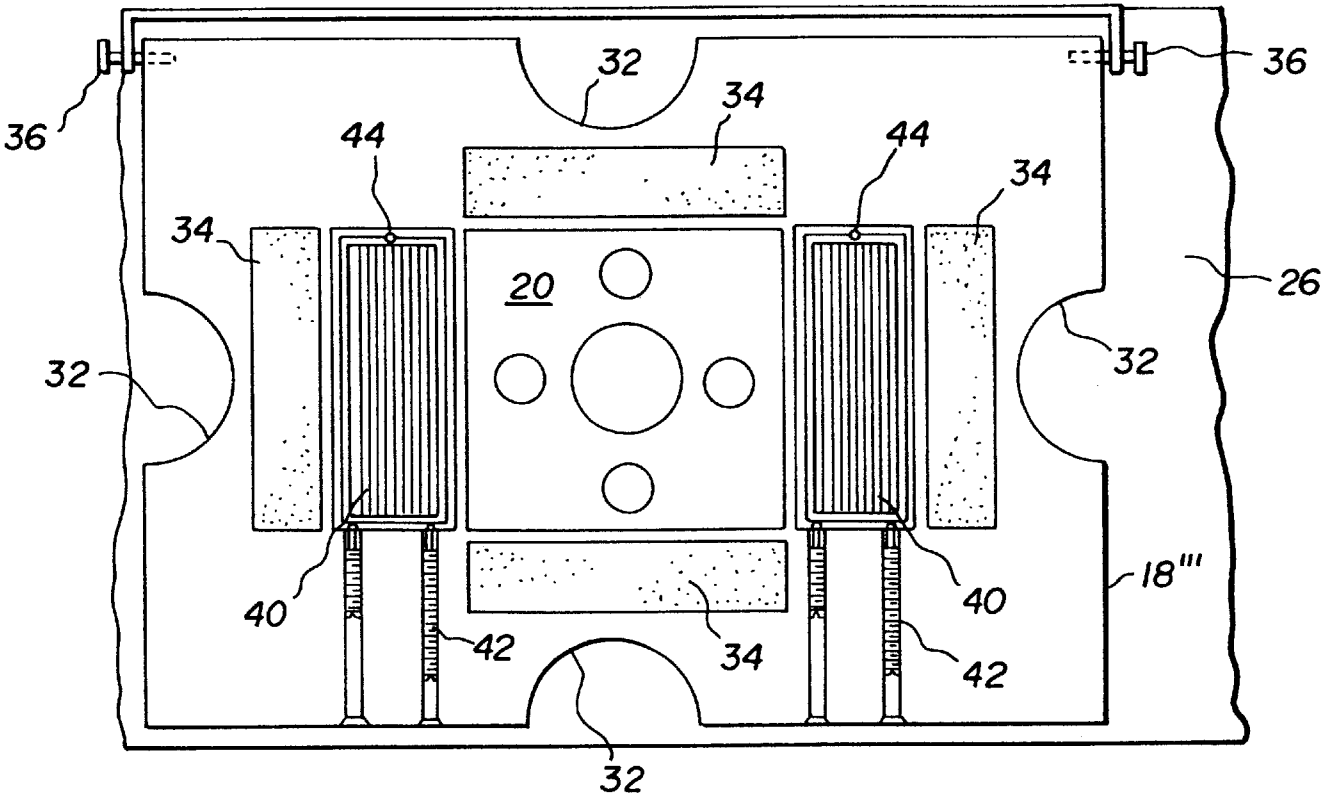
FIG. 5 is a top view of a steel rule die with adjustable lenticular cover sheets over a pair of multi-view alignment target windows.
Figure 6:
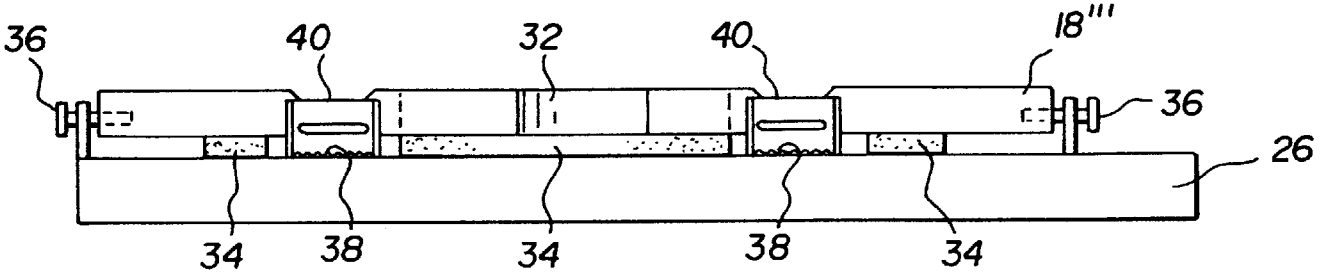
FIG. 6 is a side view of the steel rule die of FIG. 5.

Another arrangement of the paper cutter's upper body portion 18 is shown as 18'" in FIG. 5 and its associated side view, FIG. 6. In this arrangement movable guide plates of lenticular material 40 are provided with adjustment screws 42 that are used to accurately achieve alignment of the guide plates of lenticular material 40 with the die cutter 20 so that variations in temperature, initial machining tolerances, etc. can be tuned out of the cutter assembly. Each of the guide plates of lenticular material 40 is pivotly mounted to the top portion 18'" by pivot pins 44. Extension or retraction of the adjustment screws 42 rotate the guide plates of lenticular material 40 about the associated pivot pin 44.

Once the aligned and cut print has been obtained, Alignment with the lenticular material can be obtained by:

- inserting the cut print into a pre-formed cavity, located behind and aligned with the lenticals, the cavity has the same relative dimensions as the print;
- aligning the print with at least one edge of the lenticular material and tacking or bonding that edge, using a back attachment means, or using a folded, heat-formed lenticular holder; and
- using a lenticular cover sheet that has the same dimensions as the cut print and inserting the lenticular cover sheet and the cut print into an "alignment apparatus" with the same internal dimensions as the overall dimensions of the lenticular cover sheet and the aligned cut print. An adhesive bonding agent applied to the front surface of the cut print or to the back surface of the lenticular cover sheet is used to bond the sheet and print into an integrated structure.

A steel rule die ("cookie cutter" type) may be used to provide an alignment punch and an alignment conduit for adhesively bonding the lenticular material (adhesive applied to the top print surface or to the underside of the lenticular material). Interior surfaces of the steel rule dies provide an alignment guide for the lenticular material.

The invention has been described with reference to preferred embodiments; However, it will be appreciated that variations and modifications can be effected by a person of ordinary skill in the art without departing from the scope of the invention.

PARTS LIST

10 die paper cutter
12 sheet of print material
12' multi-view print
14 lenticular cover plate
14' guide plate of lenticular material
16 machined opening
18 upper body portion
18' upper body portion
18" upper body portion
18'" upper body portion
20 die cutter
22 handle
24 openings

26 lower body portion
28 space
30 guide plate of lenticular material
32 cut-outs (indents)
34 anti-slip pads
36 pins
38 opening
40 movable guide plates of lenticular material
42 adjustment screws
44 pivot pins
50 index marks

What is claimed is:

1. Apparatus for accurately cutting a multi-view print from a sheet of print material having an image portion and index marks outside of said image portion, comprising:

a lower body portion;

a four-sided rectangular cutter blade residing in the lower body portion, said cutter blade having a cutting outline corresponding to the image portion of a sheet of print material to be cut;

an upper body portion rigidly positioned with respect to and spaced a distance only from said lower body portion, great enough to receive said sheet of print material said upper body portion having a first opening therethrough in alignment with and corresponding to the outline of said cutter blade; and a device connected to said cutter blade for extending said cutter blade into said first opening in said upper body portion;

a second opening defined by said upper body portion outside of said first opening and in alignment with index marks outside the image area of said sheet of print material to be cut; and a guide plate of lenticular material positioned in said second opening for viewing of said index marks on said sheet of print material to accurate orientation of said sheet of print material relative to said first opening prior to cutting with said cutter blade.

2. The apparatus of claim 1 including means in said upper body portion for allowing manipulation of said sheet of print material to accurately orientate it.

3. The apparatus of claim 1 including means for adjusting the alignment of said guide plate.

4. The apparatus of claim 1 including a hinge for hinging said upper body portion to said lower body portion.

* * * * *